US009842691B2

(12) United States Patent
Yamakita

(10) Patent No.: US 9,842,691 B2
(45) Date of Patent: Dec. 12, 2017

(54) WIRE WINDING METHOD AND WIRE WINDING APPARATUS

(71) Applicant: MURATA MANUFACTURING CO., LTD., Kyoto-fu (JP)

(72) Inventor: Takayuki Yamakita, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 41 days.

(21) Appl. No.: 15/184,707

(22) Filed: Jun. 16, 2016

(65) Prior Publication Data

US 2016/0379756 A1 Dec. 29, 2016

(30) Foreign Application Priority Data

Jun. 23, 2015 (JP) ..... 2015-125928

(51) Int. Cl.
*H01F 41/08* (2006.01)
*H01F 41/082* (2016.01)
*B65H 54/02* (2006.01)

(52) U.S. Cl.
CPC ..... *H01F 41/082* (2016.01); *B65H 54/026* (2013.01); *B65H 2701/36* (2013.01)

(58) Field of Classification Search
CPC .... H01F 41/082; H01F 41/086; H01F 41/088; B65H 2701/36; B65H 54/026; B65H 54/12; B65H 54/14
See application file for complete search history.

(56) References Cited

U.S. PATENT DOCUMENTS

2008/0203213 A1* 8/2008 Noji ..... H02K 15/095 242/433.1
2009/0159736 A1* 6/2009 Asano ..... H01F 41/096 242/444
2016/0351329 A1* 12/2016 Kanno ..... H01F 41/07
2016/0379756 A1* 12/2016 Yamakita ..... H01F 41/082 242/439.1

FOREIGN PATENT DOCUMENTS

CN 101257239 B 7/2011
JP H02-262861 A 10/1990
JP 2010-147132 A 7/2010

* cited by examiner

*Primary Examiner* — Emmanuel M Marcelo
(74) *Attorney, Agent, or Firm* — Studebaker & Brackett PC

(57) ABSTRACT

A wire winding method which can prevent twisting tendency of a wire and the occurrence of damage on the wire. The wire winding method includes: a first step of making a plurality of wires pass through a tensioner and a nozzle sequentially and fixing distal ends of the plurality of wires to a core side; and a second step of winding the plurality of wires on the core while twisting the plurality of wires by making the nozzle revolve around the core such that a mutual positional relationship between a plurality of wire insertion holes formed in the nozzle through which the plurality of wires are made to pass respectively with respect to the tensioner is set to a fixed value.

9 Claims, 8 Drawing Sheets

WIRE WINDING METHOD AND WIRE WINDING APPARATUS

CROSS REFERENCE TO RELATED APPLICATIONS

This application claims benefit of priority to Japanese Patent Application 2015-125928 filed Jun. 23, 2015, the entire content of which is incorporated herein by reference.

TECHNICAL FIELD

The present disclosure relates to a wire winding method and a wire winding apparatus.

BACKGROUND

Conventionally, as a wire winding method for winding a plurality of wires around a core of a coil component, there has been known a wire winding method disclosed in JP-A-2010-147132. This wire winding method includes: a first step of making two wires pass through a guide and a nozzle sequentially and connecting distal ends of two wires to the core; a second step of forming a twisted portion of the wires between the guide and the nozzle as well as between the nozzle and the coil by making the nozzle rotate in a normal direction predetermined number of times; a third step of winding the twisted portion of the wires between the nozzle and the coil on the core by making the core rotate; and a fourth step of untwisting the twisted portion of the wires between the guide and the nozzle by making the nozzle rotate in a reverse direction.

SUMMARY

Inventors of the present disclosure have found that the following drawbacks arise in an actual use of the above-mentioned conventional wire winding method. That is, in untwisting two wires which are already twisted one time between the guide and the nozzle, there is a possibility that twisting tendency is imparted to two wires between the guide and the nozzle or films of the wires between the guide and the nozzle are rubbed against each other so that the wire is damaged.

Accordingly, it is an object of the present disclosure to provide a wire winding method and a wire winding apparatus which can prevent twisting tendency of a wire and the occurrence of a damage on the wire.

To overcome the above-mentioned drawbacks, according to one aspect of the present disclosure, there is provided a wire winding method for winding a plurality of wires around a core of a coil component. The wire winding method includes: a first step of making the plurality of wires pass through a tensioner and a nozzle sequentially and fixing distal ends of the plurality of wires to the core; and a second step of winding the plurality of wires on the core while twisting the plurality of wires by making the nozzle revolve around the core such that a mutual positional relationship between a plurality of wire insertion holes provided in the nozzle with respect to the tensioner is set to be constant, the plurality of wires being made to pass through the plurality of wire insertion holes respectively.

According to the wire winding method of the present disclosure, the plurality of wires are wound on the core while being twisted by making the nozzle revolve around the core such that a mutual positional relationship between the plurality of wire insertion holes provided in the nozzle through which the plurality of wires are made to pass respectively with respect to the tensioner is set to be constant.

Accordingly, it is possible to twist only the plurality of wires between the nozzle and the core without twisting the plurality of wires between the tensioner and the nozzle. In this manner, the plurality of wires between the tensioner and the nozzle are not twisted and hence, twisting tendency is not imparted to the plurality of wires between the tensioner and the nozzle and, at the same time, there is no possibility that films of the wires between the tensioner and the nozzle are damaged by rubbing.

In one mode of the wire winding method, in the second step, the core is made to rotate in the same direction as a rotational direction of the nozzle while the nozzle is made to revolve around the core.

According to this mode, the core is made to rotate in a direction equal to a rotational direction of the nozzle while the nozzle is made to revolve around the core and hence, twisting pitches of the plurality of wires per unit turn can be changed easily.

In another mode of the wire winding method, a rotational speed (number of revolutions) of the nozzle is set larger than a rotational speed (number of rotations) of the core.

According to this mode, a rotational speed of the nozzle is set larger than a rotational speed of the core and hence, twisting pitches of the plurality of wires per unit turn can be increased. Accordingly, the improvement of a mode conversion characteristic can be expected.

In another mode of the wire winding method, in the second step, the core is made to rotate in a direction opposite to the rotational direction of the nozzle while the nozzle is made to revolve around the core.

According to this mode, the core is made to rotate in a direction opposite to the rotational direction of the nozzle while the nozzle is made to revolve around the core and hence, the plurality of wires can be rapidly wound on the core.

According to another aspect of the present disclosure, there is provided a method of manufacturing a coil component where the coil component is manufactured by winding the wire on the core using the above-mentioned wire winding method.

According to the manufacturing method of the present disclosure, the coil component is manufactured by winding the wire on the core using the above-mentioned wire winding method and hence, it is possible to manufacture a coil component which has neither twisting tendency of the wire nor a damage on the wire.

According to another aspect of the present disclosure, there is provided a wire winding apparatus for winding a plurality of wires around a core of a coil component. The wire winding apparatus includes: a tensioner which imparts tension to the plurality of wires; a nozzle which has a plurality of wire insertion holes through which the plurality of wires are made to pass respectively, the tension being applied to the plurality of wires by the tensioner; and a nozzle drive section which is configured to wind the plurality of wires on the core while twisting the plurality of wires by making the nozzle revolve around the core such that a mutual positional relationship of a plurality of wire insertion holes provided in the nozzle with respect to the tensioner is set to be constant.

According to the wire winding apparatus of the present disclosure, the nozzle has the plurality of wire insertion holes through which the plurality of wires to which the tension is applied by the tensioner are made to pass respectively. The nozzle drive section winds the plurality of wires on the core while twisting the plurality of wires by making the nozzle revolve around the core such that a mutual positional relationship of the plurality of wire insertion holes formed in the nozzle with respect to the tensioner is set to be constant.

Accordingly, it is possible to twist only the plurality of wires between the nozzle and the core without twisting the plurality of wires between the tensioner and the nozzle. In this manner, the plurality of wires between the tensioner and the nozzle are not twisted and hence, twisting tendency is not imparted to the plurality of wires between the tensioner and the nozzle and, at the same time, there is no possibility that films of the wires between the tensioner and the nozzle are damaged by rubbing.

Further, in one mode of the wire winding apparatus, the wire winding apparatus includes a core drive section which is configured to make the core rotate in the same direction as a rotational direction of the nozzle.

According to this mode, the core drive section rotates the core in a direction equal to the rotational direction of the nozzle. Accordingly, the core can be rotated in a direction equal to the rotational direction of the nozzle while the nozzle is made to revolve around the core and hence, twisting pitches of the plurality of wires per unit turn can be easily changed.

In another mode of the wire winding apparatus, the core drive section is configured to set a rotational speed of the nozzle larger than a rotational speed of the core.

According to this mode, the core drive section can set a rotational speed of the nozzle larger than a rotational speed of the core and hence, twisting pitches of the plurality of wires per unit turn can be increased. Accordingly, the improvement of a mode conversion characteristic can be expected.

In another mode of the wire winding apparatus, the wire winding apparatus includes a core drive section which is configured to make the core rotate in a direction opposite to the rotational direction of the nozzle.

According to this mode, the core drive section makes the core rotate in the direction opposite to the rotational direction of the nozzle. Accordingly, the core can be rotated in the direction opposite to the rotational direction of the nozzle while the nozzle is made to revolve around the core and hence, a plurality of wires can be rapidly wound on the core.

According to the wire winding method and the wire winding apparatus of the present disclosure, a plurality of wires between the tensioner and the nozzle are not twisted and hence, twisting tendency is not imparted to the plurality of wires between the tensioner and the nozzle and, at the same time, films of the wires between the tensioner and the nozzle are not damaged by rubbing.

DETAILED DESCRIPTION

Hereinafter, the present disclosure is described in detail with reference to embodiments shown in drawings.

First Embodiment

Figure 1:
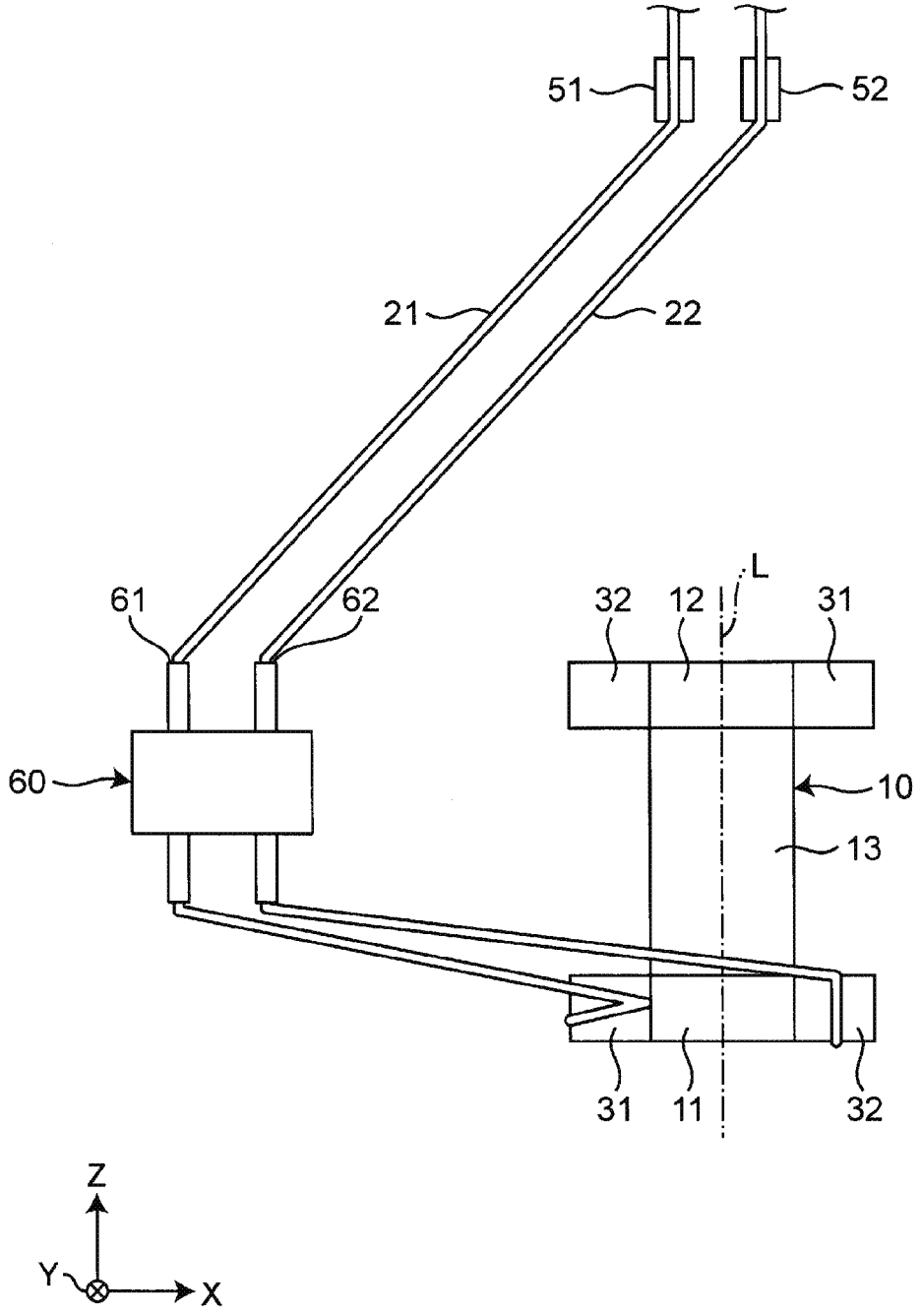
FIG. 1 is an explanatory view showing a wire winding method according to a first embodiment of the present disclosure.

FIG. 1 is an explanatory view showing a wire winding method according to a first embodiment of the present disclosure. As shown in FIG. 1, the wire winding method is a method for winding first and second wires 21, 22 around a core 10 of a coil component. The coil component is manufactured by winding the first and second wires 21, 22 on the core 10. The coil component is, for example, a common mode choke coil.

The core 10 includes a core part 13, a first flange part 11 formed on one end of the core part 13, and a second flange part 12 formed on the other end of the core part 13. As a material for forming the core 10, for example, a material such as alumina (nonmagnetic material), Ni—Zn based ferrite (magnetic material, insulating material) or a resin is used.

The core part 13 has a rectangular parallelepiped shape, for example. The first flange part 11 and the second flange part 12 have a rectangular flat plate, for example. A first electrode 31 and a second electrode 32 are mounted on a bottom surface of the first flange part 11 and a bottom surface of the second flange part 12 respectively. As materials for forming the first and second electrodes 31, 32, for example, Ag or the like is used. The first and second electrodes 31, 32 are electrically connected to electrodes on a mounting board not shown in the drawing.

The first and second wires 21, 22 respectively have a lead line and a film which covers the lead line. A primary side coil is formed by winding the first wire 21 on the core 10. A secondary coil is formed by winding the second wire 22 on the core 10.

Next, the wire winding method is described.

First, the first and second wires 21, 22 are made to pass through first and second tensioners 51, 52 and a nozzle 60 sequentially and, thereafter, distal ends of the first and second wires 21, 22 are fixed to a core 10 side. This step is referred to as a first step hereinafter.

In the first step, the first and second wires 21, 22 are reeled out from coil bobbins not shown in the drawings. The first tensioner 51 applies tension to the first wire 21. The second tensioner 52 applies tension to the second wire 22.

The nozzle 60 has first and second wire insertion holes 61, 62. The first wire 21 to which tension is applied by the first tensioner 51 is made to pass through the first wire insertion hole 61. The second wire 22 to which tension is applied by the second tensioner 52 is made to pass through the second wire insertion hole 62.

The distal end of the first wire 21 is connected to a first electrode 31 mounted on the first flange part 11 of the core 10, and the distal end of the second wire 22 is connected to a second electrode 32 mounted on the first flange part 11 of the core 10. Tension is applied to the first and second wires 21, 22 between the first and second tensioners 51, 52 and the core 10 by the first and second tensioners 51, 52. The core 10 is installed on an XY plane such that a direction of a longitudinal axis L which connects the first flange part 11 and the second flange part 12 is aligned with a Z direction.

Figure 2:
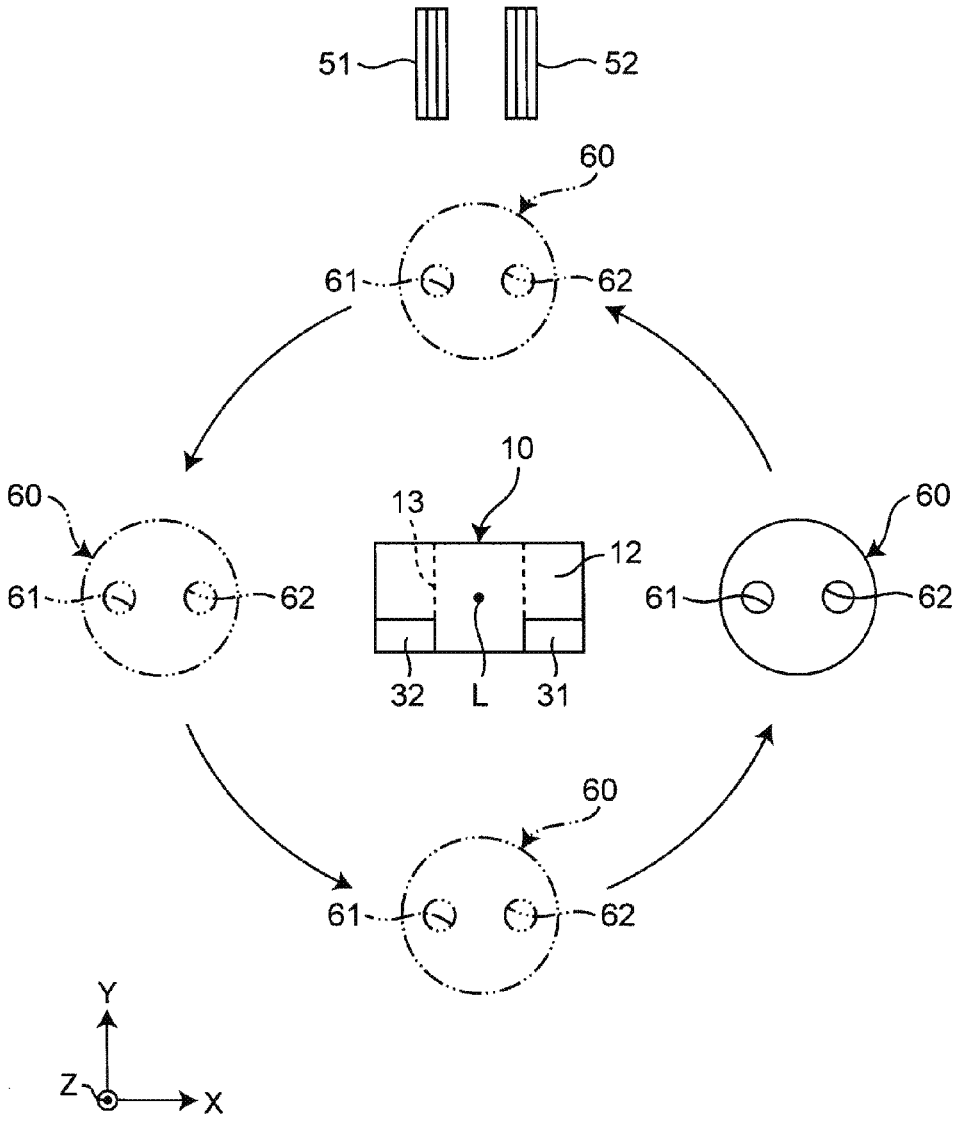
FIG. 2 is a plan view showing the wire winding method according to the first embodiment.

After the first step is finished, as shown in FIG. 2 which is a plan view, the first and second wires 21, 22 are wound on the core 10 while being twisted by making the nozzle 60 revolve around the core 10 such that a mutual positional relationship between the first and second wire insertion holes 61, 62 formed in the nozzle 60 with respect to the first and second tensioners 51, 52 is set to a fixed value. Hereinafter, this step is referred to as a second step.

In the second step, the nozzle 60 revolves around the core 10 about a Z axis. At this stage of the operation, the lateral positional relationship between the first and second wire insertion holes 61, 62 with respect to the first and second tensioners 51, 52 is not changed.

Figure 3:
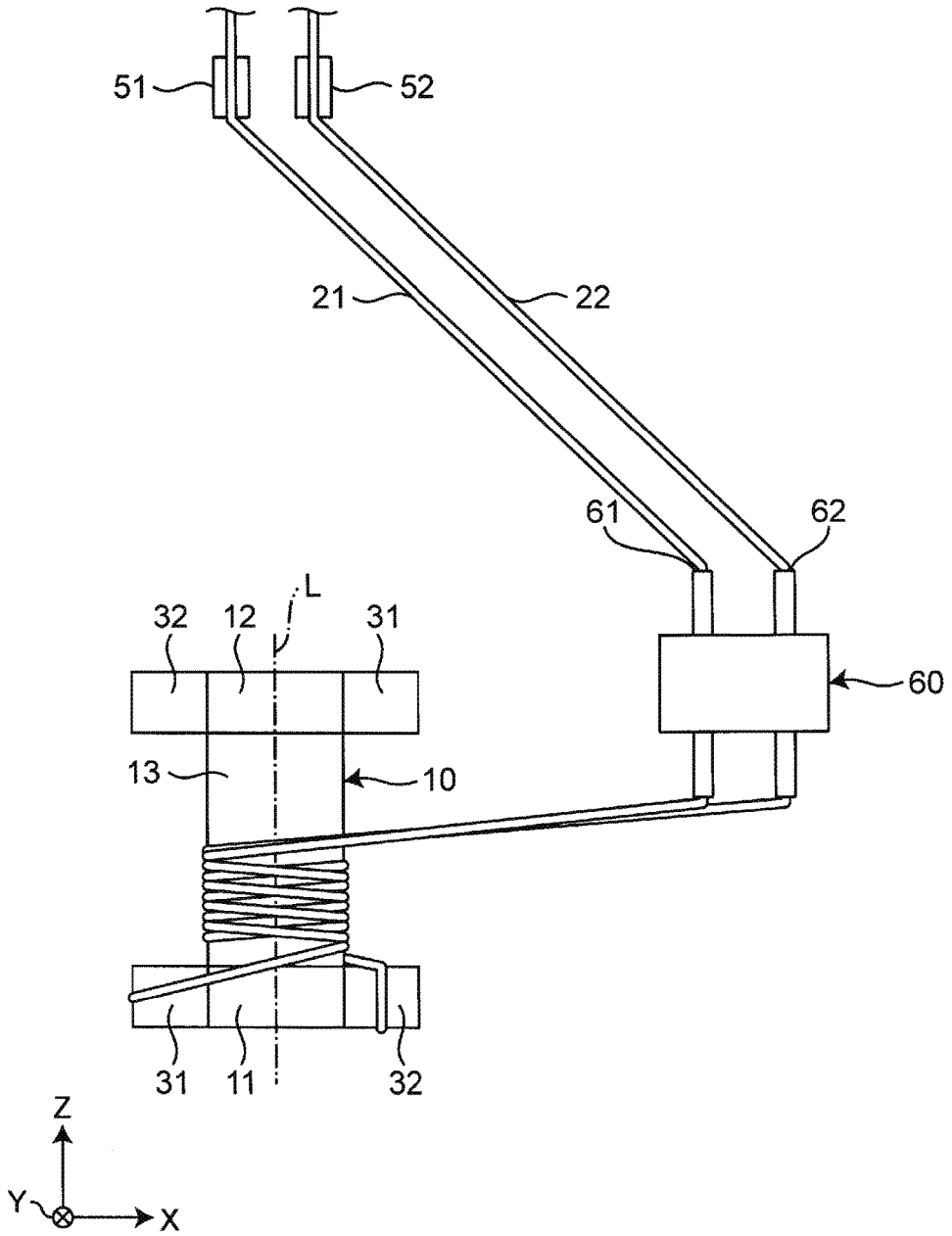
FIG. 3 is an explanatory view showing the wire winding method according to the first embodiment.

By making the nozzle 60 revolve as described above, as shown in FIG. 3, it is possible to twist only the first and second wires 21, 22 between the nozzle 60 and the core 10 without twisting the first and second wires 21, 22 between the first and second tensioners 51, 52 and the nozzle 60. Further, by moving the nozzle 60 toward the second flange portion 12 from the first flange portion 11 along the Z direction, the first and second wires 21, 22 can be wound on the core 11 toward the second flange part 12 from the first flange part 11.

Accordingly, the first and second wires 21, 22 between the first and second tensioners 51, 52 and the nozzle 60 are not twisted and hence, twisting tendency is not imparted to the first and second wires 21, 22 between the first and second tensioners 51, 52 and the nozzle 60 and, at the same time, the films of the first and second wires 21, 22 between the first and second tensioners 51, 52 and the nozzle 60 are not damaged by rubbing. In short, by twisting only portions of the first and second wires 21, 22 wound on the core 10, it is possible to prevent the first and second wires 21, 22 from being damaged so that a possibility of the occurrence of short circuiting or breakage of the first and second wires 21, 22 is reduced whereby lowering of reliability and the occurrence of troubles on facilities can be suppressed.

Further, the first and second wires 21, 22 can be wound on the core part 13 while twisting the first and second wires 21, 22 (enabling twisted winding) and hence, a coil component can acquire stable coil characteristics. In this embodiment, it is possible to make the first and second wires 21, 22 cross each other twice for every one turn regardless of a size of the core part 13.

Figure 4:
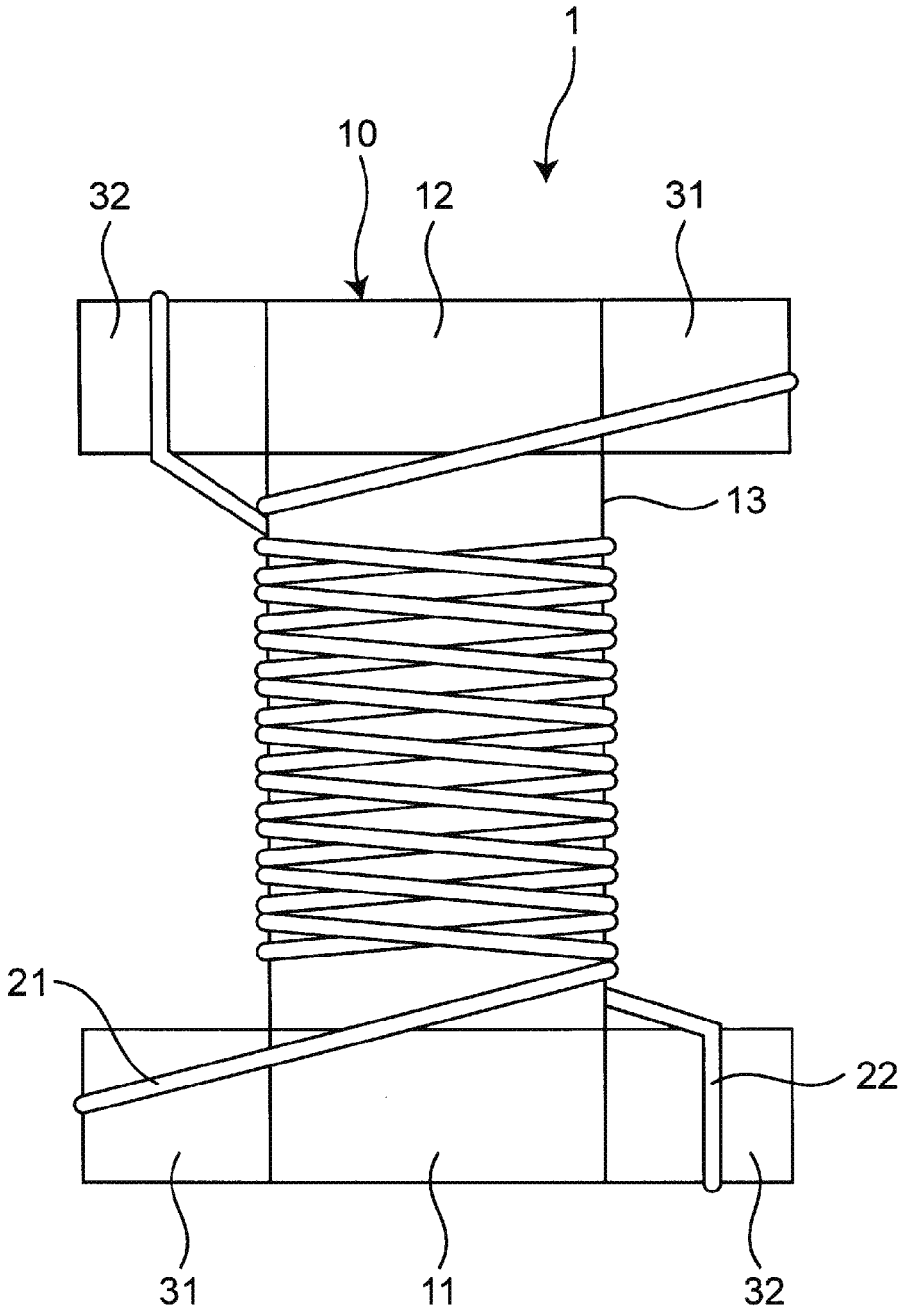
FIG. 4 is a plan view showing a coil component.

In the second step, after the first and second wires 21, 22 are wound on the core part 13, as shown in FIG. 4, a winding end portion of the first wire 21 is connected to the first electrode 31 mounted on the second flange part 12 of the core 10, and a winding end portion of the second wire 22 is connected to the second electrode 32 of the second flange portion 12 mounted on the core 10. The coil component 1 is manufactured through these steps. By manufacturing the coil component 1 by winding the wires 21, 22 on the core 10 using the above-mentioned wire winding method, it is possible to manufacture the coil component 1 where the imparting of twisting tendency to the wires 21, 22 or the occurrence of a damage on the wires 21, 22 are prevented.

Next, a wire winding apparatus is described.

Figure 5:
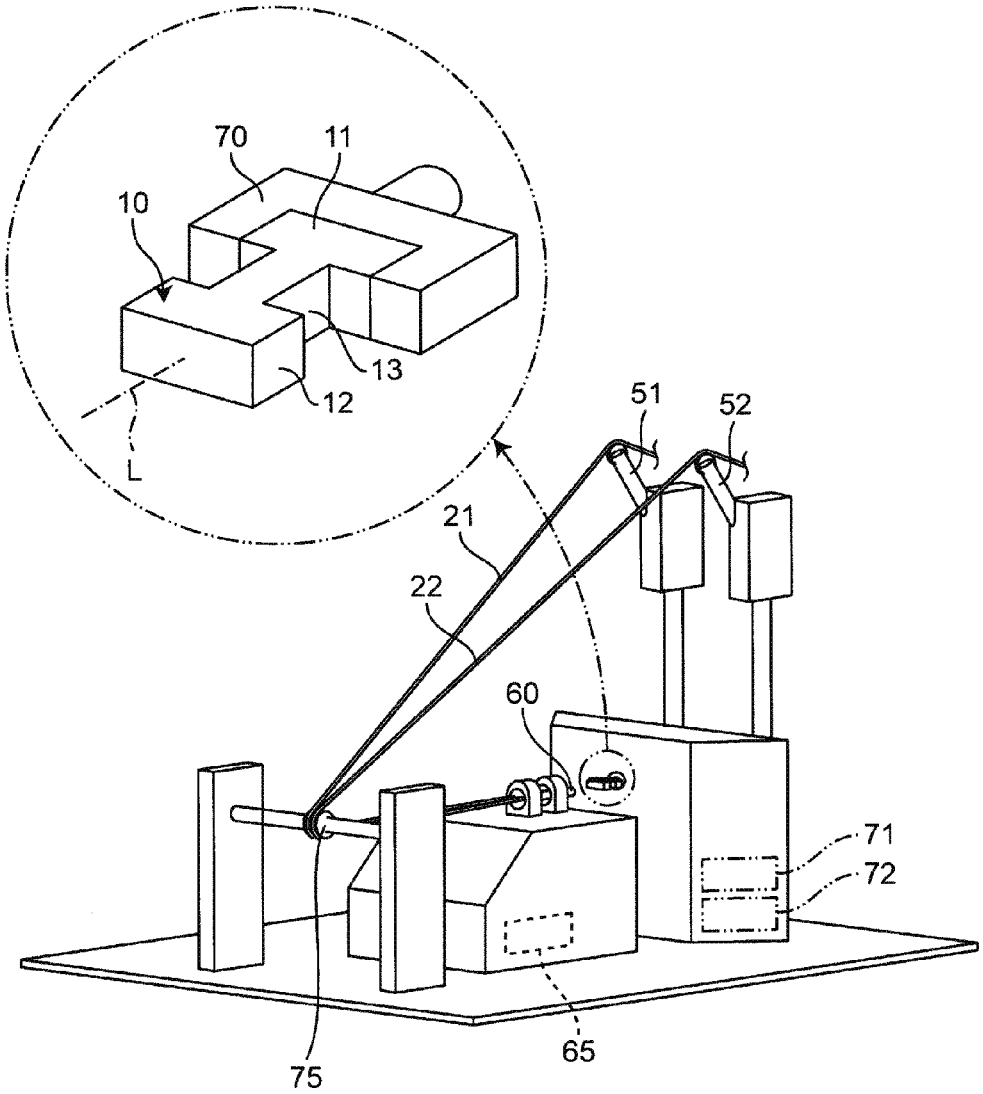
FIG. 5 is a schematic perspective view showing a wire winding apparatus according to the first embodiment of the present disclosure.

As shown in FIG. 5, the wire winding apparatus includes: the first and second tensioners 51, 52; the nozzle 60; a chuck 70 which grips the core 10; and a nozzle drive section 65 which drives the nozzle 60. The first and second tensioners 51, 52 and the nozzle 60 have the configurations described previously. A pulley 75 is disposed between the first and second tensioners 51, 52 and the nozzle 60, and guides the first and second wires 21, 22.

The chuck 70 fixes the first flange part 11 of the core 10 by gripping. At this stage of operation, the core 10 is disposed such that the direction of the longitudinal axis L of the core 10 is directed toward a nozzle 60 side.

The nozzle drive section 65 is configured to wind the first and second wires 21, 22 on the core 10 while twisting the first and second wires 21, 22 by making the nozzle 60 revolve around the core such that a mutual positional relationship between the first and second wire insertion holes 61, 62 formed in the nozzle 60 with respect to the first and second tensioners 51, 52 is set to a fixed value. That is, the nozzle drive section 65 makes the nozzle 60 revolve about the longitudinal axis L of the core 10 and, at the same time, move the nozzle 60 along the direction of the longitudinal axis L of the core 10.

According to the wire winding apparatus, by operating the nozzle drive section 65, the first and second wires 21, 22 are wound on the core 10 while being twisted by making the nozzle 60 revolve around the core 10 such that the mutual positional relationship between the first and second wire insertion holes 61, 62 formed in the nozzle 60 with respect to the first and second tensioners 51, 52 is set to a fixed value.

Accordingly, it is possible to twist only the first and second wires 21, 22 between the nozzle 60 and the core 10 without twisting the first and second wires 21, 22 between the first and second tensioners 51, 52 and the nozzle 60. In this manner, the first and second wires 21, 22 between the first and second tensioners 51, 52 and the nozzle 60 are not twisted and hence, twisting tendency is not imparted to the first and second wires 21, 22 between the first and second tensioners 51, 52 and the nozzle 60, and films of the first and second wires 21, 22 between the first and second tensioners 51, 52 and the nozzle 60 are not damaged by rubbing.

Second Embodiment

Figure 6:
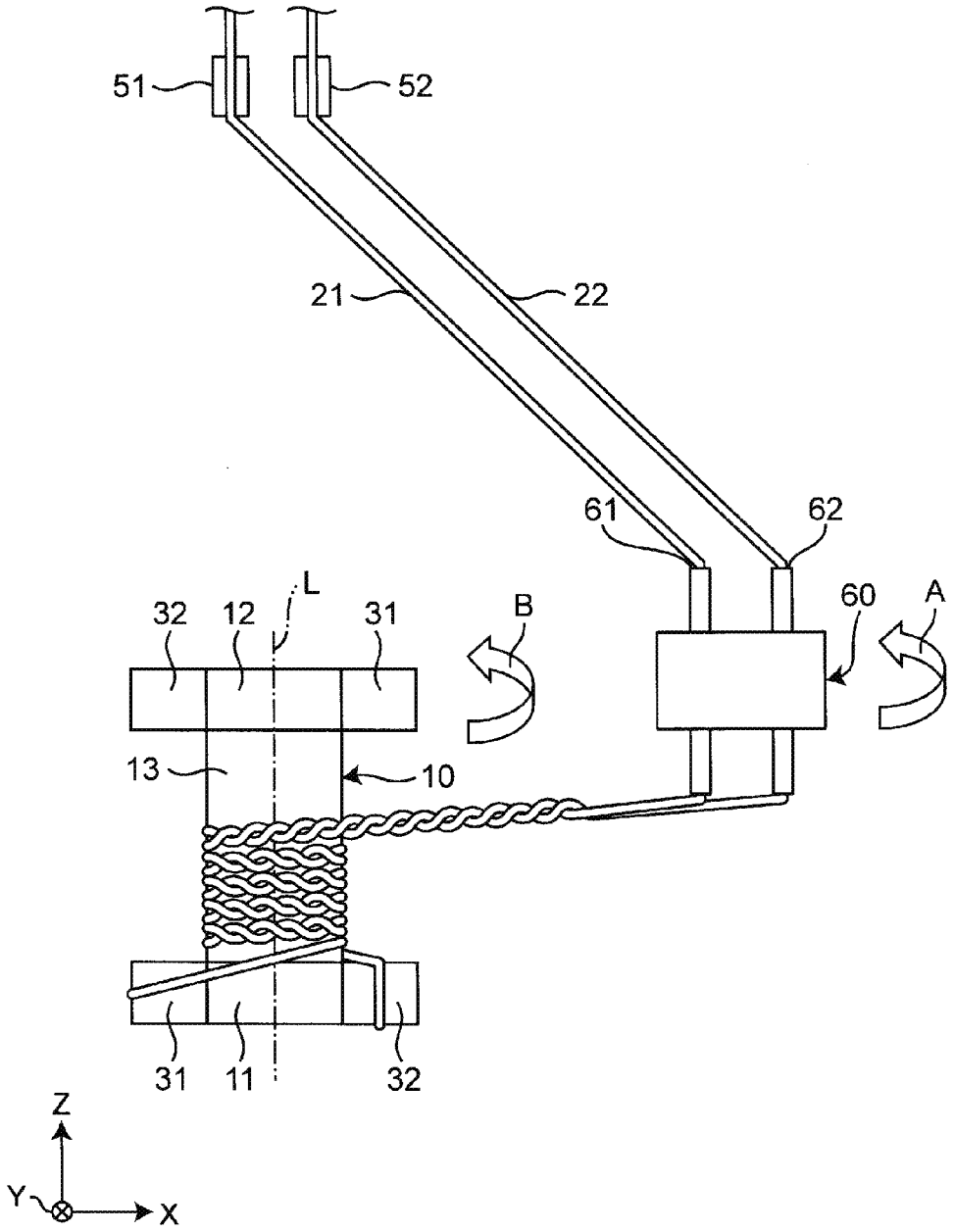
FIG. 6 is an explanatory view showing a wire winding method according to a second embodiment of the present disclosure.

FIG. 6 is an explanatory view showing a wire winding method according to a second embodiment of the present disclosure. The second embodiment differs from the first embodiment only with respect to a second step. Only this different point is described hereinafter.

As shown in FIG. 6, in the second step of the wire winding method according to the second embodiment, in addition to the second step of the wire winding method according to the first embodiment, the core 10 is made to rotate in a direction (a direction indicated by an arrow B) equal to a rotational direction (a direction indicated by an arrow A) of the nozzle 60 while the nozzle 60 is made to revolve around the core 10. That is, the nozzle 60 is made to revolve about the longitudinal axis L of the core 10 and, at the same time, the core 10 is made to rotate about the longitudinal axis L of the core 10.

Figure 7:
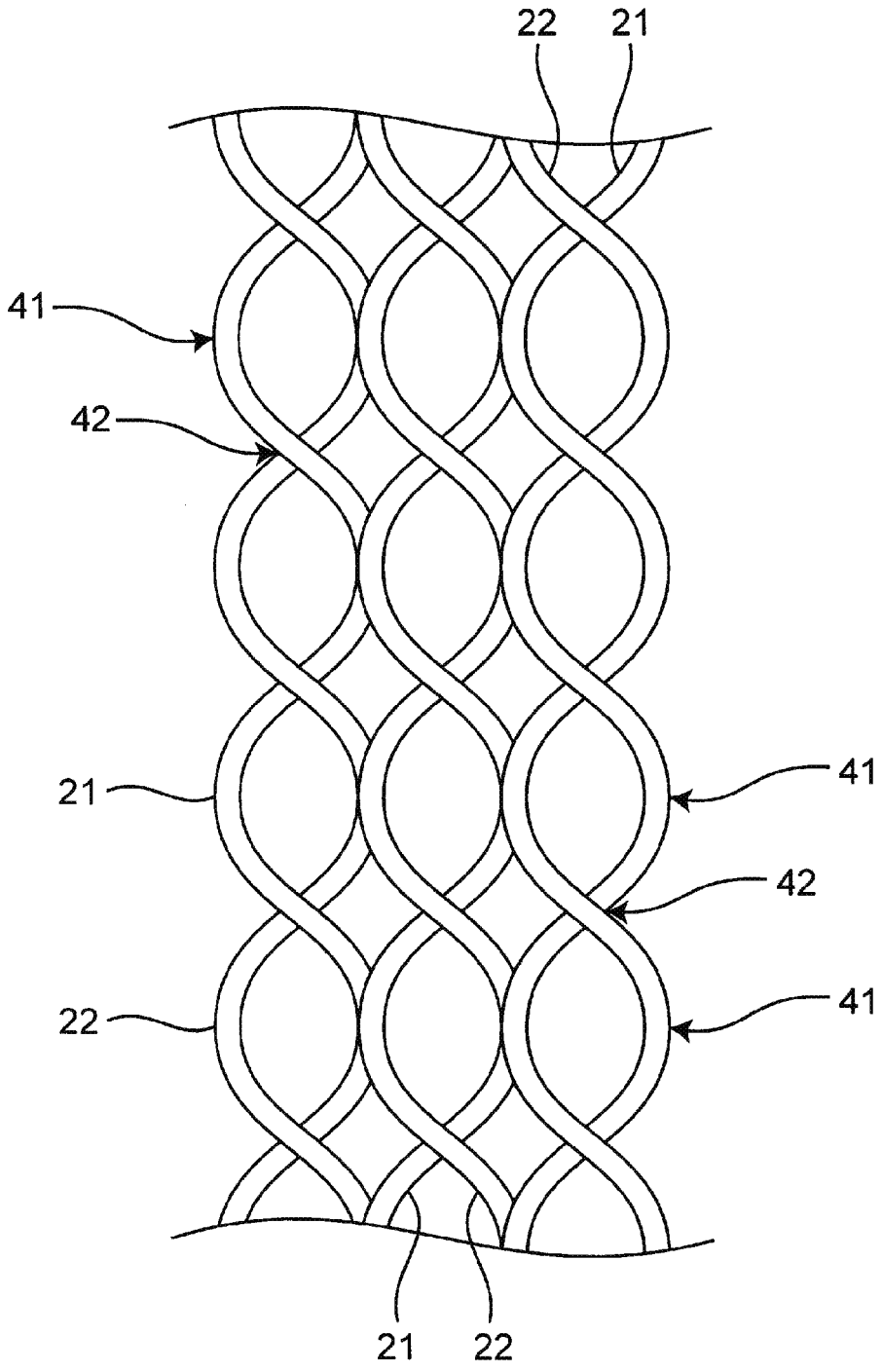
FIG. 7 is an explanatory view showing twisting of wires.

In this manner, while the nozzle 60 is made to revolve around the core 10, the core 10 is made to rotate in the direction equal to the rotational direction of the nozzle 60 and hence, twisting pitches of the first and second wires 21, 22 per unit turn can be easily changed. For example, as shown in FIG. 7, due to twisting of the first and second wires 21, 22, antinode portions 41 and node portions 42 are formed. Further, in turns disposed adjacently to each other, the antinode portion 41 of one turn and the antinode portion 41 of the other turn can be arranged in a row. In this manner, by arranging the positions of the antinode portions 41 in a row and also arranging the positions of the node portions 42 in a row, the occurrence of irregularity in characteristics can be suppressed.

A rotational speed N1 of the nozzle 60 may be set larger than a rotational speed N2 of the core 10. In this case, twisting pitches of the first and second wires 21, 22 per unit turn can be increased and hence, the improvement of a mode conversion characteristic can be expected. To be more specific, a twisting amount per unit turn is expressed as N1/N2. Further, the step of winding the first and second wires 21, 22 on the core 10 and the step of twisting the first and second wires 21, 22 can be performed simultaneously.

A rotational speed N1 of the nozzle 60 may be set equal to a rotational speed N2 of the core 10. In this case, the first and second wires 21, 22 are only twisted without being wound on the core 10. Accordingly, the step of winding the first and second wires 21, 22 on the core 10 and the step of twisting the first and second wires 21, 22 can be performed independently. For example, it may be possible to adopt a mode where, first, the first and second wires 21, 22 are twisted and, thereafter, the twisted first and second wires 21, 22 are wound on the core 10.

Next, a wire winding apparatus according to the second embodiment is described.

To describe the configuration of the wire winding apparatus according to the second embodiment with reference to FIG. 5, the wire winding apparatus according to the second embodiment further includes a first core drive section 71 which drives the core 10 in addition to the configuration of the wire winding apparatus according to the first embodiment. The first core drive section 71 makes the core 10 rotate in a direction equal to the rotational direction of the nozzle 60. Accordingly, it is possible to make the core 10 rotate in the direction equal to the rotational direction of the nozzle 60 while the nozzle 60 is made to revolve around the core 10 and hence, twisting pitches of the first and second wires 21, 22 per unit turn can be easily changed.

The first core drive section 71 may set a rotational speed of the nozzle 60 larger than a rotational speed of the core 10 or may increase twisting pitches of the first and second wires 21, 22 per unit turn.

Third Embodiment

Figure 8:
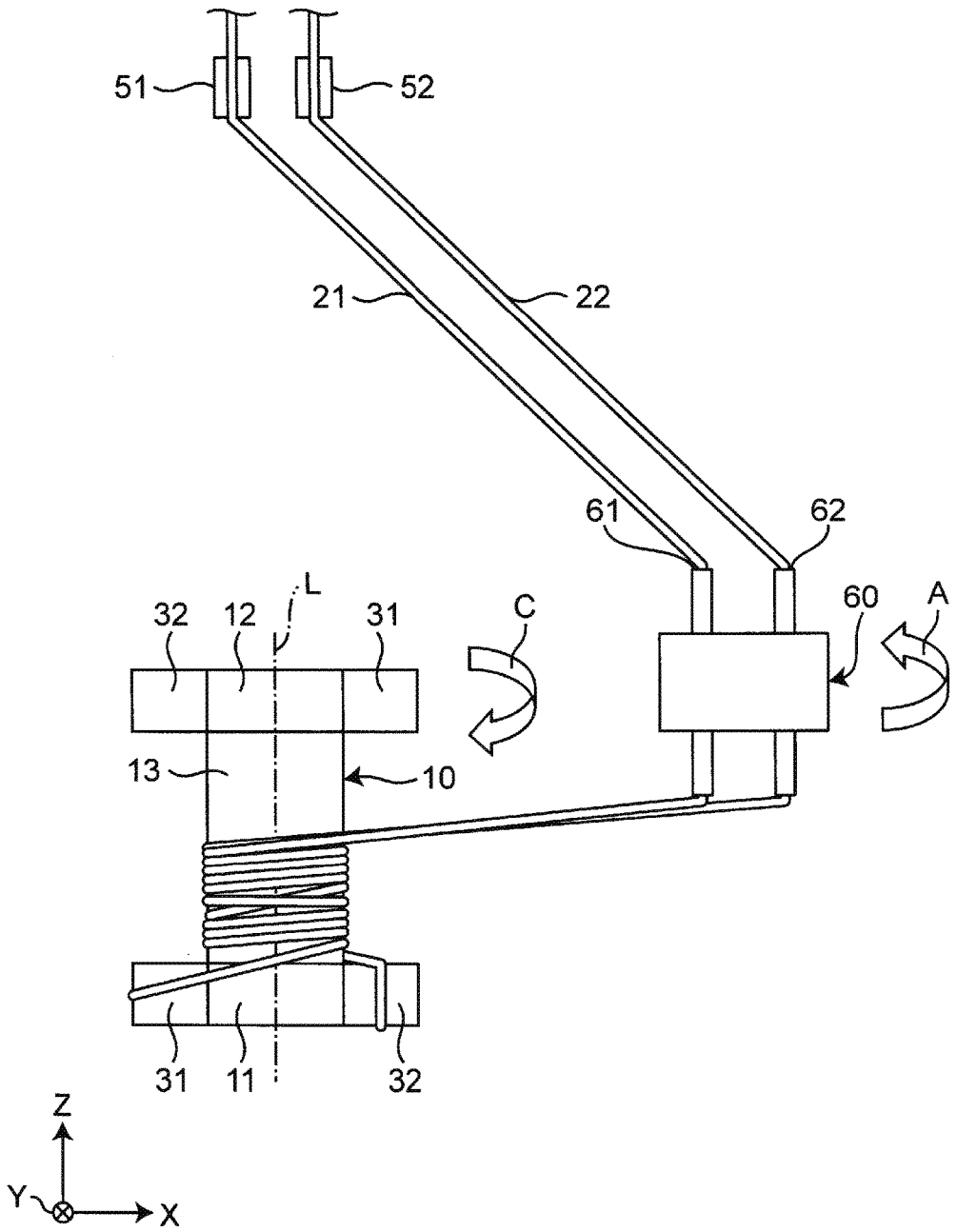
FIG. 8 is an explanatory view showing a wire winding method according to a third embodiment of the present disclosure.

FIG. 8 is an explanatory view showing a wire winding method according to a third embodiment of the present disclosure. The third embodiment differs from the first embodiment only with respect to a second step. Only this different point is described hereinafter.

As shown in FIG. 8, in the second step of the wire winding method according to the third embodiment, in addition to the second step of the wire winding method according to the first embodiment, the core 10 is made to rotate in a direction (a direction indicated by an arrow C) opposite to a rotational direction (a direction indicated by an arrow A) of the nozzle 60 while the nozzle 60 is made to revolve around the core 10. That is, the nozzle 60 is made to revolve about the longitudinal axis L of the core 10 and, at the same time, the core 10 is made to rotate about the longitudinal axis L of the core 10.

In this manner, while the nozzle 60 is made to revolve around the core 10, the core 10 is made to rotate in the direction opposite to the rotational direction of the nozzle 60 and hence, the first and second wires 21, 22 can be rapidly wound on the core 10.

Further, by adjusting a rotational speed N1 of the nozzle 60 and a rotational speed N2 of the core 10, a twisting amount per unit turn can be adjusted. To be more specific, a twisting amount per unit turn is expressed as 1/(N1+N2).

Next, a wire winding apparatus according to the third embodiment is described.

To describe the configuration of the wire winding apparatus according to the third embodiment with reference to FIG. 5, the wire winding apparatus according to the third embodiment further includes a second core drive section 72 which drives the core 10 in addition to the configuration of the wire winding apparatus according to the first embodiment. The second core drive section 72 makes the core 10 rotate in a direction opposite to the rotational direction of the nozzle 60. Accordingly, it is possible to make the core 10 rotate in the direction opposite to the rotational direction of the nozzle 60 while the nozzle 60 is made to revolve around the core 10 and hence, the first and second wires 21, 22 can be rapidly wound on the core 10.

The present disclosure is not limited to the above-mentioned embodiments, and various changes in design are conceivable without departing from the gist of the present disclosure. For example, the respective technical features of the first to third embodiments may be combined in various manner.

In the above-mentioned embodiments, two wires are wound on the core. However, three or more wires may be wound on the core. In this case, the nozzle has three or more wire insertion holes.

In the above-mentioned embodiments, the nozzle is made to revolve around the core after the distal ends of the wires are connected to the electrodes mounted on the core. However, the wire winding method may be performed such that the nozzle is made to revolve around the core after the distal ends of the wires are temporarily fixing to the core or the distal ends of the wires are fixed to the chuck which grips the core and, thereafter, the distal ends of the wires are connected to the electrodes mounted on the core.

In the above-mentioned embodiments, the nozzle is moved along the direction of the longitudinal axis of the core. However, the core may be moved along the direction of the longitudinal axis of the core with respect to the nozzle.

In the above-mentioned embodiments, the first and second core drive sections are provided independently. However, both the first and second core drive sections are provided, and one of the core drive sections may be selectively used.

What is claimed is:

1. A wire winding method for winding a plurality of wires around a core of a coil component, the wire winding method comprising:

a first step of making the plurality of wires pass through a tensioner and a nozzle sequentially and fixing distal ends of the plurality of wires to the core; and a second step of winding the plurality of wires on the core while twisting the plurality of wires by making the nozzle revolve around the core such that a mutual positional relationship of a plurality of wire insertion holes provided in the nozzle with respect to the tensioner is set to be constant, the plurality of wires being made to pass through the plurality of wire insertion holes respectively.

2. The wire winding method according to claim 1, wherein in the second step, the core is made to rotate in the same direction as a rotational direction of the nozzle while the nozzle is made to revolve around the core.

3. The wire winding method according to claim 2, wherein a rotational speed of the nozzle is set larger than a rotational speed of the core.

4. The wire winding method according to claim 1, wherein in the second step, the core is made to rotate in a direction opposite to the rotational direction of the nozzle while the nozzle is made to revolve around the core.

5. A method of manufacturing a coil component where the coil component is manufactured by winding the wire on the core using the wire winding method according to claim 1.

6. A wire winding apparatus for winding a plurality of wires around a core of a coil component, the wire winding apparatus comprising:

a tensioner which imparts tension to the plurality of wires;

a nozzle which has a plurality of wire insertion holes through which the plurality of wires are made to pass respectively, the tension being applied to the plurality of wires by the tensioner; and a nozzle drive section which is configured to wind the plurality of wires on the core while twisting the plurality of wires by making the nozzle revolve around the core such that a mutual positional relationship of the plurality of wire insertion holes provided in the nozzle with respect to the tensioner is set to be constant.

7. The wire winding apparatus according to claim 6, further comprising a core drive section which is configured to make the core rotate in the same direction as a rotational direction of the nozzle.

8. The wire winding apparatus according to claim 7, wherein the core drive section is configured to set a rotational speed of the nozzle larger than a rotational speed of the core.

9. The wire winding apparatus according to claim 6, further comprising a core drive section which is configured to make the core rotate in a direction opposite to the rotational direction of the nozzle.

* * * * *